US008066592B2

(12) United States Patent
Forester

(10) Patent No.: US 8,066,592 B2
(45) Date of Patent: Nov. 29, 2011

(54) DAMPENING SYSTEM FOR STRINGED-RACQUET

(75) Inventor: Wayne Forester, Asheville, NC (US)

(73) Assignee: Nike, Inc., Beaverton, OR (US)

( * ) Notice: Subject to any disclaimer, the term of this patent is extended or adjusted under 35 U.S.C. 154(b) by 191 days.

(21) Appl. No.: 12/107,054

(22) Filed: Apr. 21, 2008

(65) Prior Publication Data

US 2010/0075787 A1 Mar. 25, 2010

Related U.S. Application Data

(60) Provisional application No. 60/913,259, filed on Apr. 20, 2007.

(51) Int. Cl.
*A63B 49/00* (2006.01)

(52) U.S. Cl. ..... 473/522; 36/132; 36/136

(58) Field of Classification Search ..... 473/520, 473/522; 36/132, 136
See application file for complete search history.

(56) References Cited

U.S. PATENT DOCUMENTS 2,344,421 A * 3/1944 Schwartz ..... 36/1
4,458,373 A * 7/1984 Maslow ..... 12/142 LC
4,575,083 A * 3/1986 Adam ..... 473/522
4,609,194 A * 9/1986 Krent et al. ..... 473/522
4,621,441 A * 11/1986 Wagner et al. ..... 40/636
4,712,319 A * 12/1987 Goria ..... 36/137
4,732,383 A * 3/1988 Ferrari et al. ..... 473/522
4,761,007 A * 8/1988 Boschian ..... 473/522
4,776,590 A * 10/1988 Krent et al. ..... 473/522
4,909,509 A * 3/1990 Boschian ..... 473/522
4,911,445 A * 3/1990 Ferrari et al. ..... 473/522
4,927,143 A 5/1990 Hillock
4,962,928 A * 10/1990 Camara et al. ..... 473/522
5,022,651 A * 6/1991 Barone ..... 473/522
5,158,286 A * 10/1992 Soong ..... 473/522
5,169,146 A * 12/1992 Soong ..... 473/522
5,211,397 A * 5/1993 Davis et al. ..... 473/522
5,367,795 A 11/1994 Iverson et al.
5,402,589 A * 4/1995 Lubrani et al. ..... 36/50.1
5,538,244 A * 7/1996 Gibert ..... 473/553
5,673,501 A * 10/1997 Mathews ..... 36/136
5,871,409 A * 2/1999 Kimoto ..... 473/522
6,033,324 A * 3/2000 Nashif et al. ..... 473/520
6,364,791 B1 * 4/2002 Janes ..... 473/522
6,502,329 B1 * 1/2003 Silagy ..... 36/50.1
7,014,579 B1 * 3/2006 Sung ..... 473/522
7,335,118 B1 * 2/2008 Sung ..... 473/461
7,517,293 B1 * 4/2009 Smith ..... 473/522
7,530,910 B1 * 5/2009 Niksich et al. ..... 473/522

(Continued)

OTHER PUBLICATIONS

International Search Report; PCT app. No. PCT/US08/61070; Apr. 21, 2008; 2 pages.

(Continued)

*Primary Examiner* — Raleigh W. Chiu
(74) *Attorney, Agent, or Firm* — Harness, Dickey & Pierce P.L.C.

(57) ABSTRACT

A system for storing one or more stringed-racquet vibration dampeners on an article of apparel so that they are easily accessible during game play is disclosed. In disclosed embodiments, the vibration dampener is detachably secured to an article of footwear by way of an opening in the upper of the shoe, such as at the tongue or the like. The dampening device may provide surface ornamentation thereon, such as a logo, other indicia, or a color scheme selectable by the wearer.

20 Claims, 3 Drawing Sheets

U.S. PATENT DOCUMENTS

| | | | | |
|---|---|---|---|---|
| 7,556,575 | B2 * | 7/2009 | Lammer et al. | 473/522 |
| 7,572,196 | B2 * | 8/2009 | Kotze et al. | 473/522 |
| 2004/0023738 | A1 * | 2/2004 | Sung | 473/522 |
| 2004/0254034 | A1 | 12/2004 | Tymchyn | |
| 2005/0016028 | A1 * | 1/2005 | Safdeye | 36/132 |
| 2006/0010721 | A1 * | 1/2006 | Valko | 36/136 |
| 2007/0169382 | A1 * | 7/2007 | Bongard | 36/136 |
| 2008/0086917 | A1 * | 4/2008 | Carrillo | 36/136 |
| 2008/0163514 | A1 * | 7/2008 | Stassinopoulos | 36/100 |
| 2008/0271348 | A1 * | 11/2008 | Fromm | 36/136 |
| 2009/0300948 | A1 * | 12/2009 | Nordstrom-Wehner | 36/136 |
| 2010/0005686 | A1 * | 1/2010 | Baum | 36/100 |
| 2010/0011623 | A1 * | 1/2010 | Seckler et al. | 36/136 |

OTHER PUBLICATIONS

Written Opinion of the International Searching Authority; PCT app. No. PCT/US08/61070; Apr. 21, 2008; 4 pages.

Notification of Transmittal of the International Search Report; PCT app. No. PCT/US08/61070; Apr. 21, 2008; 1 page.

* cited by examiner

DAMPENING SYSTEM FOR STRINGED-RACQUET

CROSS-REFERENCE TO RELATED APPLICATION

This application claims priority to U.S. provisional patent application Ser. No. 60/913,259, filed on Apr. 20, 2007.

TECHNICAL FIELD

The invention relates to an article of sporting apparel with a vibration dampener for a stringed-racquet detachably secured thereto.

BACKGROUND OF THE INVENTION

The use of vibration dampening devices on stringed sporting racquets, such as tennis racquets, squash racquets, racquetball racquets and the like is widely known. Such dampening devices absorb vibration created when a ball strikes the surface of the racquet, reducing the transmission of the vibration through the strings of the racquet to the handle and ultimately that hand and arm of the player. Vibration that is transferred to the hand and arms can cause sport-related injuries such as "tennis elbow" and the like. In addition, vibration dampeners also help maintain proper string tension, thereby increasing the power exerted by the ratchet on a ball.

Such dampening devices are usually installed on a stringed-racquet in one of two ways. They are installed concurrently when the racquet is strung. Alternatively, they are installed after the racquet is strung, usually by detachably securing the dampener between two adjacent strings.

Because of the forces exerted on the face of the racquet during play, dampening devices, and in particular detachably secured dampening devices, tend to fall out during play. Moreover, players tend to lose, misplace and forget their vibration dampeners when they are detached from their racquets, thereby rendering them useless.

Typically, when a dampening device falls from a racquet during play or a player determines that one or more dampening devices are needed for a particular situation, they cannot be quickly and easily located. Accordingly, a player must either stop the game to locate the dampening device, or continue playing without the benefit of the dampening device.

SUMMARY OF THE INVENTION

Accordingly, despite the benefits of detachably securing a dampening device to a racquet, there remains a need for a system for storing one or more dampeners so that they are easily accessible during play. The present invention fulfills these and other needs.

A vibration dampener is detachably secured to an article of footwear. Should a player lose a vibration dampener or elect to add one during play, the player detaches a vibration dampener from the article of footwear and installs the dampener between two adjacent strings on the player's racquet. The player quickly and conveniently replaces the dampener to avoid the undesirable effects of playing without a dampener while not having to postpone play or leave the playing area.

In disclosed embodiments, a replaceable dampening device is detachably secured to the article of footwear by way of an opening in the upper of the shoe, for example, the tongue. Preferably, the opening has a flange that engages a slot located around the lateral edge of the dampening device.

The surface of the dampening device may provide surface ornamentation thereon, such as a logo, other indicia, or a color scheme selectable by the wearer.

The dampening device may also be made of materials of varying vibration absorption capability to accommodate the player's preference of vibration absorption and string tension.

DETAILED DESCRIPTION OF PREFERRED EMBODIMENT

Figure 1A:
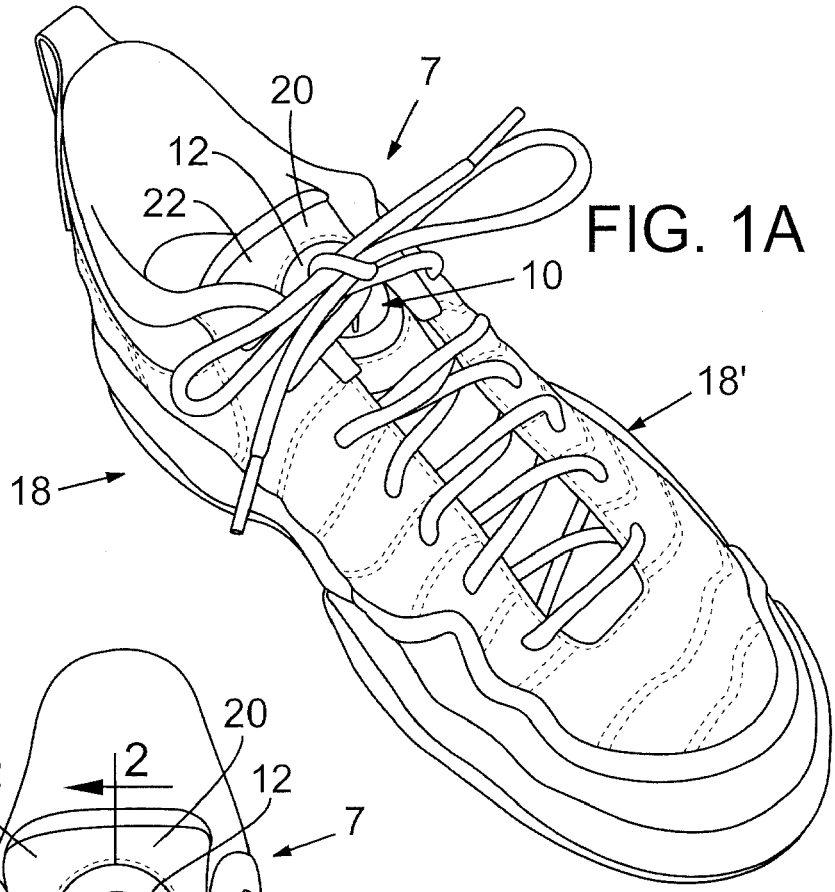
FIG. 1A is a front isometric view of an article of footwear with a replaceable dampening device installed in the tongue of the article of footwear depicting a possible shoelace in a tied position.
Figure 1B:
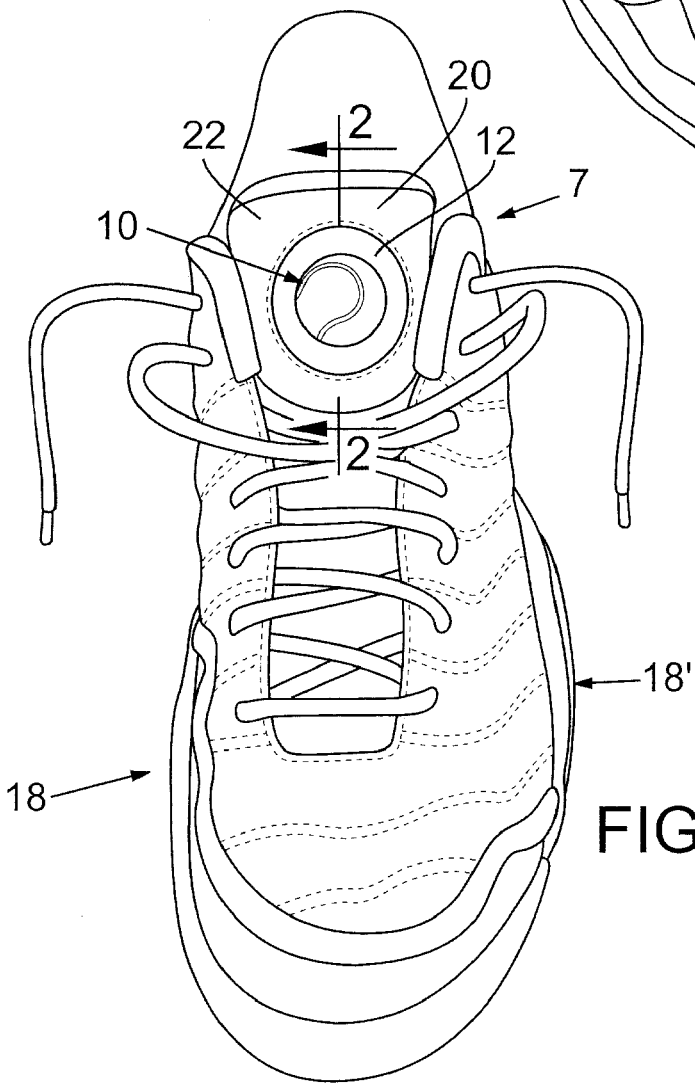
FIG. 1B is a front isometric view of an article of footwear of FIG. 1B with the possible shoelace in an untied position to provide access to the dampening device.
Figure 2:
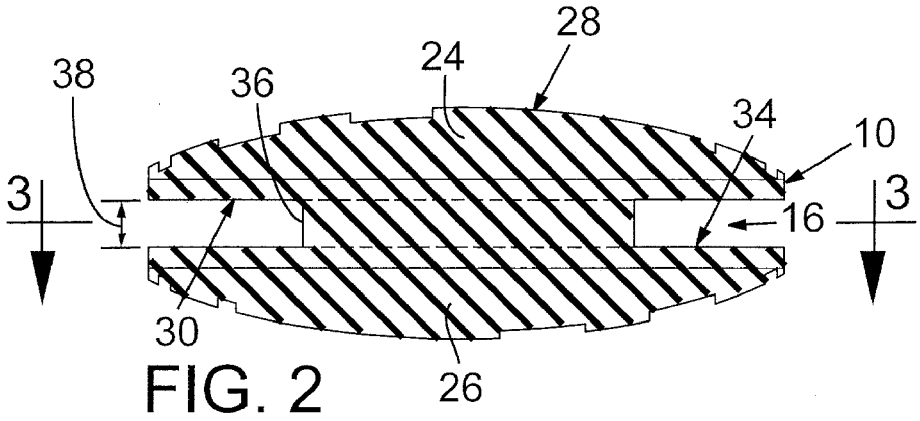
FIG. 2 is a cross-sectional view of the replaceable dampening device taken along line 2-2 of FIG. 1B.
Figure 3:
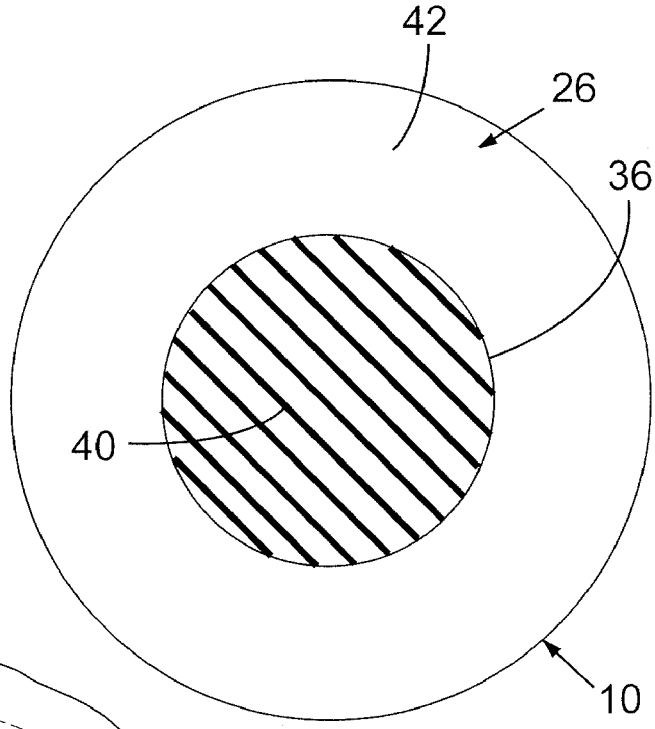
FIG. 3 is a cross sectional view of the dampening device of FIG. 2 taken along line 3-3 of FIG. 2.
Figure 4:
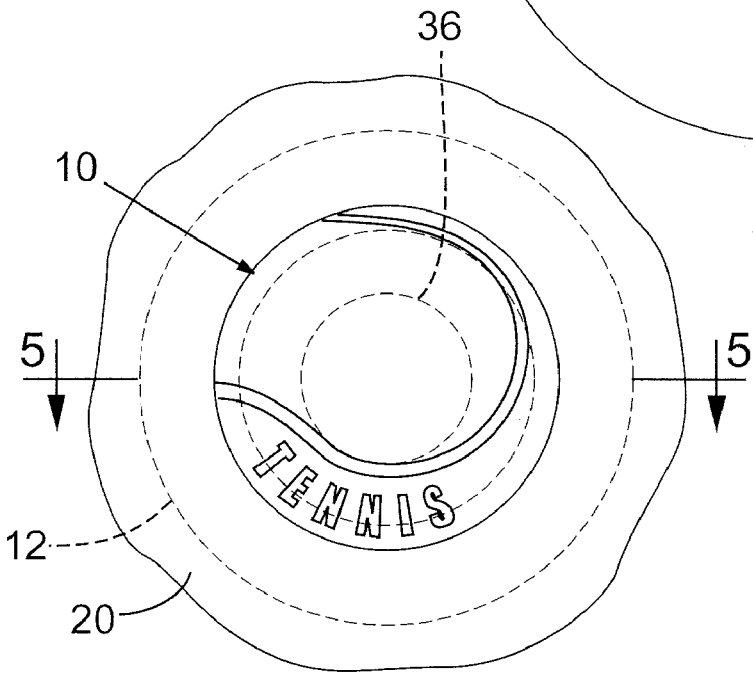
FIG. 4 is a top fragmentary view of a replaceable dampening device of FIG. 2 showing a possible attachment to an article of apparel, shown in partial view.

A dampening system 7 for a stringed-racquet 8 (FIG. 6) is shown in FIGS. 1-6. When not in use on a racquet 8 (FIG. 6), a conventional stringed-racquet dampening device 10 is detachably secured to an article of apparel 18, such as an article of footwear 18' or the like, Preferably, a dampening device mount 12 is operably secured to the article of apparel 18. The mount 12 allows the dampening device 10 to be detachably secured thereto. For example, as best shown in FIGS. 1B, 2, and 4, a flange 14 is preferably secured to the article of apparel 18 for operably engaging a mating recess 16 on the dampening device 10.

Referring to FIGS. 1A and 1B, the article of apparel 18 used in the system is preferably an article of footwear 18' such as a shoe or the like. The article of footwear 18' has an outer surface 20 providing a location for the mount 12. Preferably, the mount 12 is rigidly connected to the outer surface 20 of the article of footwear 18'. The dampening device 10 is detachably secured to the mount 12, preferably by inserting the flange 14 (FIG. 5) into the mating recess 16 in the dampening device 10, thereby being readily available for use as needed.

Preferably, the mount 12 is installed on the tongue 22 of the article of footwear 18'. The mount 12 may also be connected to the article of footwear 18' at on another area of the outer surface 20. The mount 12 and the dampening device 10 can be designed using different characteristics, such as colors, sizes and graphical representations such as logos and the like to present an aesthetically pleasing appearance that coincides with the style of the shoe 18.

Figure 5:
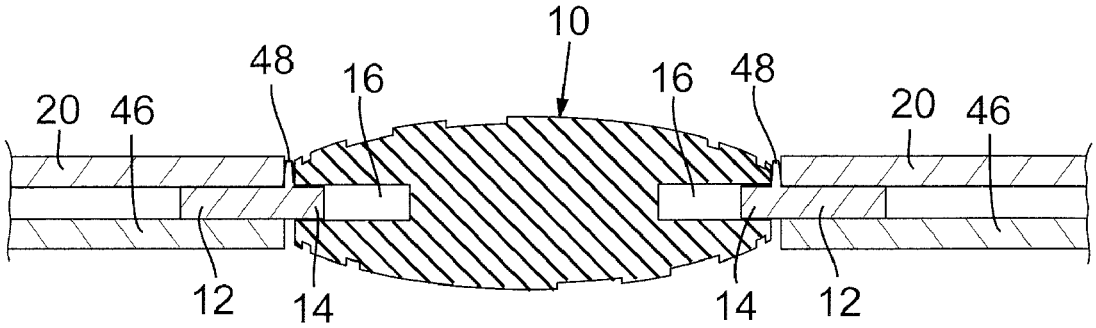
FIG. 5 is a cross sectional view of the dampening device of FIG. 4 along line 5-5 of FIG. 4.

Referring to FIGS. 2-4, a conventional detachably securable vibration dampener 10 is shown. The dampener 10 is made of a resilient material that can vary in hardness to provide different operable characteristics and allows a user to bend the dampener 10 when installing the dampener on a racquet 8 (FIG. 6) or a mount 12 (FIGS. 1*b* and 5). Preferably, the dampener 10 has a first substantially planar member 24 and a second substantially planar member 26. The first substantially planar member 24 has an outer surface 28 and an inner surface 30. Likewise, the second substantially planar member 26 has an outer surface 32 and an inner surface 34. The inner surface 30 of the first planar member 24 and the inner surface 34 of the second planar member 26 are rigidly connected by a columnar member 36 of some depth 38. Preferably, the depth 38 will be slightly smaller than the diameter of a conventional racquet string. The cross-sectional area 40 of the columnar member 36 is preferably smaller than the surface area 42 of the first and second planar members 24 and 26. The difference between the cross-sectional area of the columnar member 36 and surface areas of the planar members 24 and 26, define a void 16 between the first planar member 24 and the second planar member 26 that operably engages the strings of a racquet when in use. When not in use the dampener 10 can be detachably secured to the mount 12 for storage.

Referring to FIGS. 4 and 5, the mount 12 is preferably a flange 14 rigidly secured to the outer surface 20 of the article of apparel 18. Preferably, the mount 12 is inserted into an opening 44 in the outer surface 20 of the article 18 and rigidly secured to the article of apparel 18 between an outer layer 20 and an inner layer 46 of the article 18. The mount 12 extends inward toward the center of the opening 44 creating a flange 14 that engages the mating void 16 in the dampener 10. The resilient material of the dampener 10 allows the user to bend the dampener 10 to fit into the opening 44 and engage the flange 14 into the mating void 16. Conversely, the user can pull on the dampener 10, disengaging the flange 14 from the void 16, removing the dampener 10 so it can be installed in a racquet. Preferably the mount 12 has a protrusion 48 perpendicular to the lateral surface of the flange 14. The protrusion extends from the flange 14 through the outer surface 20 of the article 18, preventing movement of the mount from its alignment with the opening 44. While the preferred embodiment shows the mount 12 installed in an opening in the outer surface 20 of the article 18, it is also contemplated that the mount may also be rigidly secured to the outer surface by things such as snaps, hook and loop material, buttons and the like.

Figure 6:
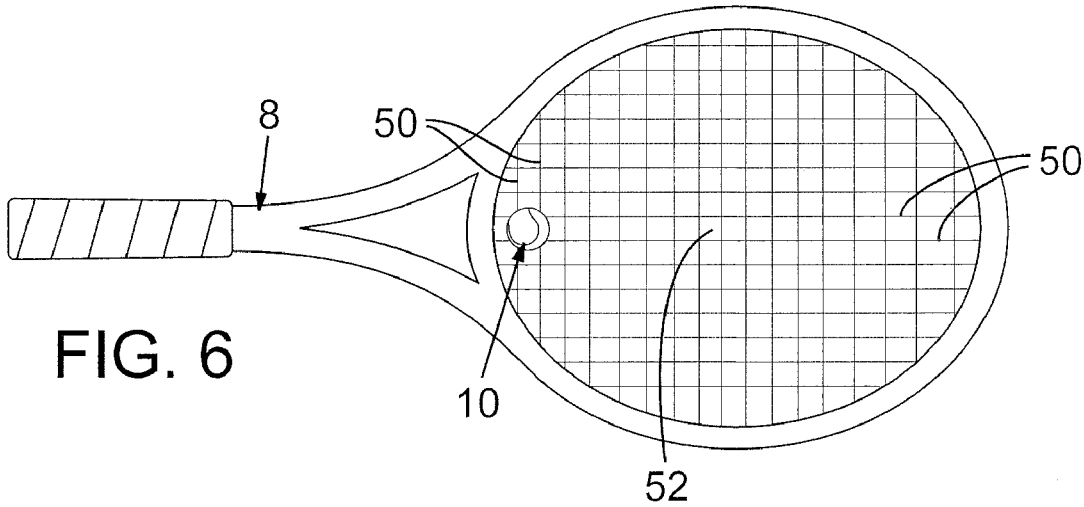
FIG. 6 is a front plan view of the dampening device 10 of FIG. 1B, showing a possible installation on a racquet.

Referring to FIG. 6, a racquet 8 with the dampener 10 detachably secured thereto is shown. The dampener 10 is inserted between adjacent strings 50 of the racquet face 52. When the racquet face 52 strikes a ball, vibration created by the impact is absorbed by the dampener through the strings 50.

To use the system, a player who finds that while using a strung racquet, is experiencing undesirable effects such as discomfort, loss of power or the like or a player who loses a detachably secured dampener from a racquet face, reaches a dampener 10 that is detachably secured to the mount 12 located somewhere on an article of apparel 18. The player removes the dampener 10 from the mount 12 by pulling on the dampener with enough force to disengage the dampener 10 from the mount 12. Once removed, the resilience of the material forming the dampener will cause it to return to its original shape and size. Once removed from its mount 12, the dampener is installed on the racquet 8 by inserting the dampener between two adjacent strings 50 in the racquet face and bending the dampener to engage each adjacent string into the mating void in the dampener. The resilient material of the dampener 10 returns to its original shape and size such that it is in contact with each of the adjacent strings and operably secured thereto.

Preferably, a plurality of mounts 12 are provided on the article of apparel 18. Accordingly, a plurality of dampeners 10, each having different physical properties such as hardness and the like can be detachably secured to the article of apparel 18. When using the system, the player then has a choice of dampener properties to choose from and may remove the dampener that provides the most benefit based on the playing conditions and the player's preferences.

When dampeners are not in use as a racquet, the dampeners preferably contain decorative features on their outer surfaces such as logos, graphical indicia, text, colors and the like. Preferably, the mounts 12 will be located in a visible location on the article of apparel allowing the player to personalize their apparel through the displaying of dampeners bearing indicia such as the player's favorite color, manufacturer, sports team and the like. In this way, the system serves to provide an aesthetically pleasing and customizable ornamentation for the article of apparel even when not being used in conjunction with a racquet.

Accordingly, the present invention includes all such modifications as may come within the scope of the following claims and equivalents thereto.

What is claimed is:

1. A dampening system, comprising:

an article of apparel;

a stringed racquet having strings;

a vibration dampener mount operably secured to the article of apparel; and a slotted vibration dampener that is detachably secured to the vibration dampener mount when the slotted vibration dampener is in a first position and the slotted vibration dampener is detachably secured to the strings of the stringed racquet when the slotted vibration dampener is in a second position.

2. The dampening system of claim 1, wherein the slotted vibration dampener has an outer surface that contains surface ornamentation thereon.

3. The dampening system of claim 1, wherein the vibration dampener mount is a flange, and the flange extends from an opening in the article of apparel.

4. The dampening system of claim 1, wherein the vibration dampener mount is rigidly secured to an outer surface of the article of apparel.

5. The dampening system of claim 1, wherein the article of apparel is an article of footwear.

6. The dampening system of claim 1, further including:

a second vibration dampener mount operably secured to the article of apparel; and a second slotted vibration dampener that is detachably secured to the second vibration dampener mount when the second slotted vibration dampener is in a first position and the second slotted vibration dampener is detachably secured to the strings of the stringed racquet when the second slotted vibration dampener is in a second position;

wherein the slotted vibration dampener has at least one first dampening property and the second slotted vibration dampener has at least one second dampening property that is different than the at least one first dampening property.

7. A dampening system, comprising:

an article of apparel;

a stringed racquet having strings;

a vibration dampener mount operably secured to the article of apparel; and a first slotted vibration dampener that is detachably secured to the vibration dampener mount when the slotted vibration dampener is in a first position and the slotted vibration dampener is detachably secured to the strings of the stringed racquet when the slotted vibration dampener is in a second position;

wherein the article of apparel and the first slotted vibration dampener are packaged together as a kit.

8. The kit dampening system of claim 7, further comprising a second slotted vibration dampener, that is detachably secured to the vibration dampener mount when the second slotted vibration dampener is in a first position and the second slotted vibration dampener is detachably secured to the strings of the stringed racquet when the second slotted vibration dampener is in a second position, wherein the article of apparel, the first slotted vibration dampener, and the second slotted vibration dampener are packaged together as the kit.

9. The dampening system of claim 8, wherein the first slotted vibration dampener has at least one first property and the second slotted vibration dampener has at least one second property that is different than the at least one first property.

10. The dampening system of claim 9, wherein the at least one first property includes a first hardness of the first slotted vibration dampener and the at least one second property includes a second hardness of the second slotted vibration dampener, and wherein the first hardness is different than the second hardness.

11. The dampening system of claim 10, wherein the first hardness corresponds to a player's first preference and the second hardness corresponds to the player's second preference.

12. The dampening system of claim 7, wherein the article of apparel is an article of footwear.

13. The dampening system of claim 12, wherein the vibration dampener mount is secured to a tongue of the article of footwear.

14. The dampening system of claim 7, wherein the first slotted vibration dampener has at least one first property that includes ornamentation of the first slotted vibration dampener, and wherein the first property is a custom selection made by a player.

15. A method of dampening vibration on a racquet having at least two strings extending thereon, the method comprising:

manufacturing an article of apparel having a rigidly secured dampening device mount;

detachably securing a dampening device to the dampening device mount;

removing the dampening device from the dampening device mount; and dampening vibration on the racquet when the racquet contacts an object by operably securing the dampening device between the at least two strings on the racquet.

16. The method of claim 15, further comprising the step of displaying surface indicia on an outside surface of the dampening device.

17. The method of claim 15, wherein the detachably securing a dampening device to the dampening device mount includes providing a flange on the article of apparel and operably securing the dampening device to the flange.

18. The method of claim 17, wherein the dampening device has a mating recess therein, and the flange operably engages the mating recess.

19. The method of claim 15, wherein the article of apparel is an article of footwear.

20. The method of claim 19, wherein the article of footwear has a tongue and the dampening device mount is secured to the tongue.

* * * * *